US009845759B2

(12) United States Patent
Clark, II et al.

(10) Patent No.: US 9,845,759 B2
(45) Date of Patent: Dec. 19, 2017

(54) SYSTEM AND METHOD FOR INDUCING A FUEL SYSTEM FAULT

(71) Applicant: GM Global Technology Operations LLC, Detroit, MI (US)

(72) Inventors: Eric Russell Clark, II, Lansing, MI (US); Wesley W. Wald, Dexter, MI (US); David E. Homyak, Ann Arbor, MI (US); Ian J. MacEwen, White Lake, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 153 days.

(21) Appl. No.: 14/960,966

(22) Filed: Dec. 7, 2015

(65) Prior Publication Data

US 2017/0159595 A1 Jun. 8, 2017

(51) Int. Cl.

| | |
|---|---|
| ***F02D 41/22*** | (2006.01) |
| ***F02D 41/14*** | (2006.01) |
| ***F02D 41/24*** | (2006.01) |
| ***F02D 41/30*** | (2006.01) |

(52) U.S. Cl.

CPC ..... *F02D 41/2467* (2013.01); *F02D 41/1454* (2013.01); *F02D 41/22* (2013.01); *F02D 41/3005* (2013.01); *F02D 2041/224* (2013.01); *F02D 2200/0406* (2013.01); *F02D 2200/0414* (2013.01); *F02D 2200/602* (2013.01); *F02D 2200/604* (2013.01)

(58) Field of Classification Search

CPC ..... F02D 41/14; F02D 41/22; F02D 41/24; F02D 41/1454; F02D 41/2467; F02D 41/3005; F02D 2041/224; F02D 2200/0406; F02D 2200/0414

See application file for complete search history.

(56) References Cited

U.S. PATENT DOCUMENTS

| | | | | |
|---|---|---|---|---|
| 6,789,523 | B2 * | 9/2004 | Oki | F02M 25/0827 123/198 D |
| 7,739,897 | B2 * | 6/2010 | Wang | G01F 25/0061 73/1.73 |
| 8,091,531 | B2 * | 1/2012 | Lucido | F02M 63/022 123/198 D |
| 8,498,799 | B2 * | 7/2013 | Matthews, Jr. | F02D 41/3094 123/525 |

FOREIGN PATENT DOCUMENTS

| | | | | |
|---|---|---|---|---|
| DE | 102010015382 | A1 * | 11/2010 | F02D 41/222 |

* cited by examiner

*Primary Examiner* — Hieu T Vo

(57) ABSTRACT

A system according to the principles of the present disclosure includes a fault command module, a fuel control module, and a fault detection module. The fault command module selectively generates a command to induce a fuel system fault based on a user input. The fuel control module automatically adjusts a fuel correction factor to a target value outside of a first predetermined range in response to the command to induce a fuel system fault. The fuel control module actuates a fuel injector associated with a cylinder of an engine based on the fuel correction factor. The fault detection module detects a fuel system fault when the fuel correction factor is outside of the first predetermined range.

20 Claims, 3 Drawing Sheets

SYSTEM AND METHOD FOR INDUCING A FUEL SYSTEM FAULT

FIELD

The present disclosure relates to internal combustion engines, and more particularly, to systems and methods for inducing a fuel system fault.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Engine control systems typically control the amount of fuel delivered to cylinders of an engine based a base fueling amount and a fuel correction factor. The base fueling amount is determined based on an amount of air drawn into the cylinders and a desired air/fuel ratio. The fuel correction factor is determined based on an input from an oxygen sensor disposed in an exhaust system of the engine.

Some engine control systems diagnose a fuel system fault when the fuel correction factor is outside of a predetermined range. When the fuel correction factor is outside of the predetermined range, the actual air/fuel ratio is typically more lean or more rich than desired. When the engine operates at a lean air fuel ratio, the engine produces increased levels of nitrogen oxide emissions. When the engine operates at a rich air fuel ratio, the engine produces increased levels of hydrocarbon and carbon monoxide emissions.

SUMMARY

A system according to the principles of the present disclosure includes a fault command module, a fuel control module, and a fault detection module. The fault command module selectively generates a command to induce a fuel system fault based on a user input. The fuel control module automatically adjusts a fuel correction factor to a target value outside of a first predetermined range in response to the command to induce a fuel system fault. The fuel control module actuates a fuel injector associated with a cylinder of an engine based on the fuel correction factor. The fault detection module detects a fuel system fault when the fuel correction factor is outside of the first predetermined range.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

As noted above, some engine control systems diagnose a fuel system fault when a fuel correction factor is outside of a predetermined range. Certain emissions tests require analyzing the emissions produced by an engine when the fuel correction factor is at a target level. The target level is set to a value outside of the predetermined range so that adjusting the fuel correction factor to the target level triggers the fuel system fault. Thus, the emissions tests are performed when the fuel correction factor is at the target level to ensure that the predetermined range is set appropriately. Typically, this is accomplished by manually adjusting the fuel correction factor using, for example, a hand held tool that interfaces with the engine control system.

If the fuel correction factor is adjusted too quickly, the amount of emissions produced is greater than desired, and the engine may exhibit performance issues such as hesitation, sags, stalls, or misfire. To avoid these issues, the fuel correction factor may be gradually adjusted from a current value to the target level. However, if the fuel correction factor is adjusted too slowly, the fuel system fault is not triggered before the end of the emissions test. Thus, if the fuel correction factor is adjusted too quickly or too slowly, the emissions test may be performed again using a different rate of adjustment for the fuel correction factor, and this process may be repeated until an acceptable rate of adjustment is found. This trial-and-error process of determining an acceptable rate of adjustment for the fuel correction factor is time consuming and may be performed for each new vehicle model.

A system and method according to the present disclosure automatically adjusts a fuel correction factor to a target level outside of the predetermined range in response to a command to induce a fuel system fault. In addition, the system and method may optimize the rate at which the fuel correction factor is adjusted based on an unadjusted value of the fuel correction factor and a change in engine speed and/or engine torque. The system and method may optimize that rate at which the fuel correction factor is adjusted based on these parameters to ensure that the fuel system fault is triggered within a desired period while avoiding performance issues such as hesitation, sags, stalls, or misfire.

Figure 1:
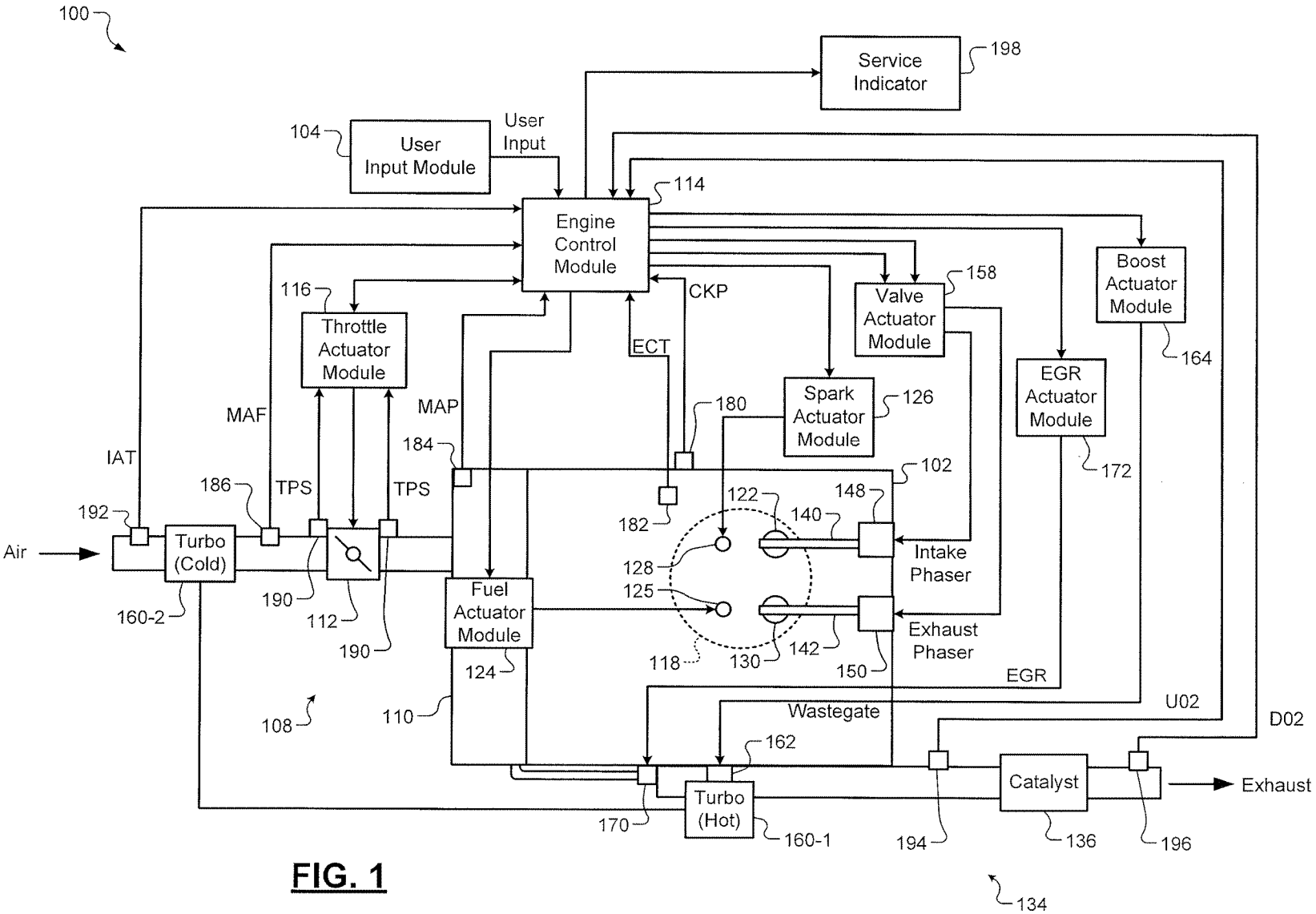
FIG. 1 is a functional block diagram of an example engine system according to the principles of the present disclosure.

Referring now to FIG. 1, an engine system 100 includes an engine 102 that combusts an air/fuel mixture to produce drive torque for a vehicle. The amount of drive torque produced by the engine 102 is based on a user input from a user input module 104. The user input may be based on a position of an accelerator pedal. The user input may also be based on a cruise control system, which may be an adaptive cruise control system that varies vehicle speed to maintain a predetermined following distance.

Air is drawn into the engine 102 through an intake system 108. The intake system 108 includes an intake manifold 110 and a throttle valve 112. The throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injections performed by a fuel injector 125 to achieve a desired air/fuel ratio. Fuel may be injected into the intake manifold 110 at a central location or at multiple locations, such as near the intake valve 122 of each of the cylinders. In various implementations, fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 to generate a spark in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a spark timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. A valve actuator module 158 may control the intake and exhaust cam phasers 148 and 150 based on signals from the ECM 114. When implemented, variable valve lift may also be controlled by the valve actuator module 158.

The ECM 114 may deactivate the cylinder 118 by instructing the valve actuator module 158 to disable opening of the intake valve 122 and/or the exhaust valve 130. The valve actuator module 158 may disable opening of the intake valve 122 by decoupling the intake valve 122 from the intake camshaft 140. Similarly, the valve actuator module 158 may disable opening of the exhaust valve 130 by decoupling the exhaust valve 130 from the exhaust camshaft 142. In various implementations, the valve actuator module 158 may actuate the intake valve 122 and/or the exhaust valve 130 using devices other than camshafts, such as electromagnetic or electrohydraulic actuators.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, which compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The exhaust system 134 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 may measure the position of the crankshaft using a crankshaft position (CKP) sensor 180.

The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. An upstream oxygen (UO2) sensor 194 measures an amount (e.g., concentration) of oxygen in the exhaust gas upstream from the catalyst 136. A downstream oxygen (DO2) sensor 196 measures an amount (e.g., concentration) of oxygen in the exhaust gas downstream from the catalyst 136.

The ECM 114 uses signals from the sensors to make control decisions for the engine system 100. For examples, the ECM 114 may diagnose various faults in the engine system 100 based on the signals from the sensors and activate a service indicator 198 when a fault is diagnosed. When activated, the service indicator 198 indicates that service is required using a visual message (e.g., text, a light, and/or a symbol), an audible message (e.g., a chime), and/or a tactile message (e.g., vibration).

Figure 2:
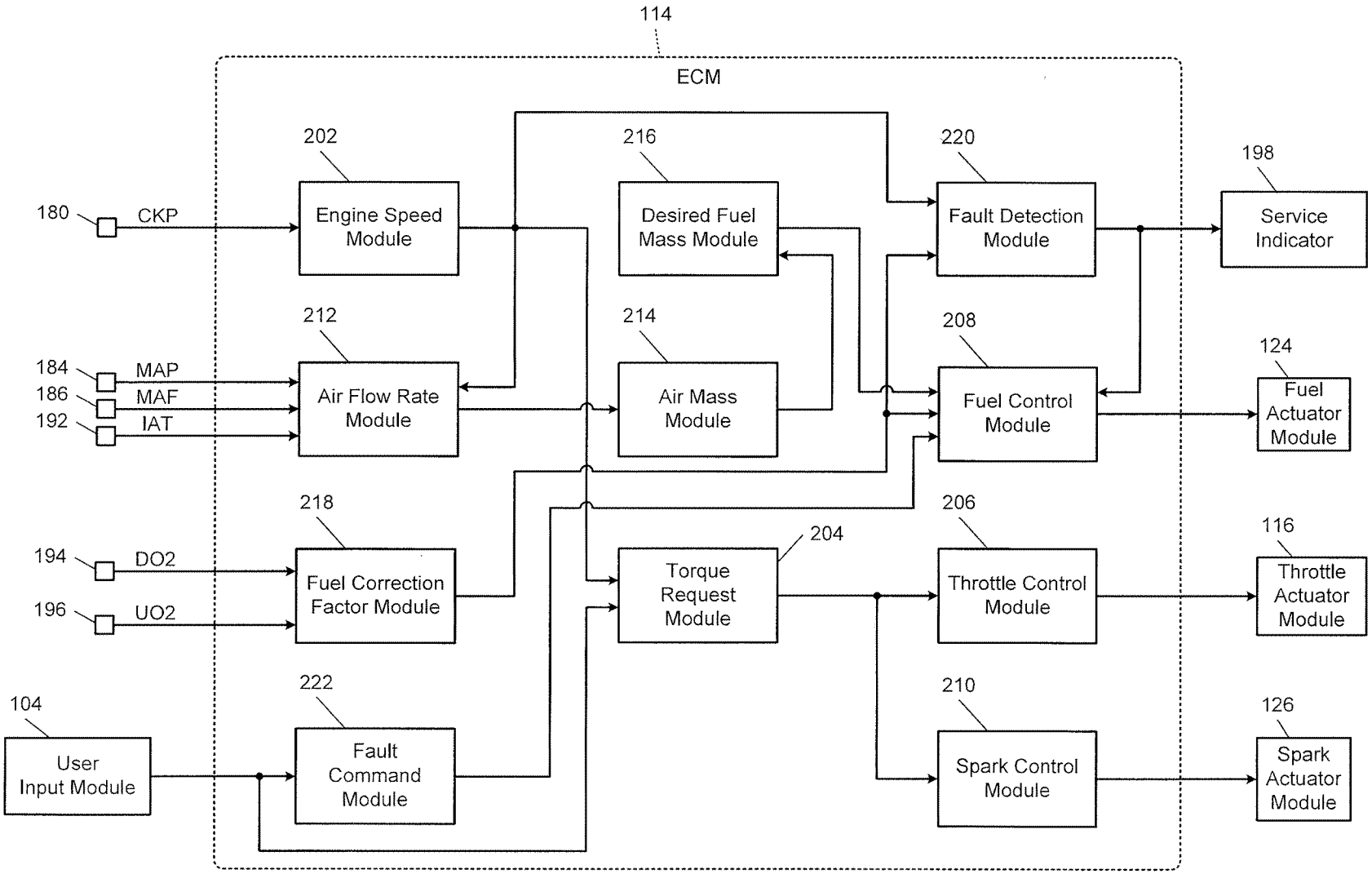
FIG. 2 is a functional block diagram of an example control system according to the principles of the present disclosure.

Referring now to FIG. 2, an example implementation of the ECM 114 includes an engine speed module 202, a torque request module 204, a throttle control module 206, a fuel control module 208, and a spark control module 210. The engine speed module 202 determines the speed of the engine 102 based on the crankshaft position from the CKP sensor 180. For example, the engine speed module 202 may calculate the engine speed based on a period that elapses as the crankshaft completes one or more revolutions. The engine speed module 202 outputs the engine speed.

The torque request module 204 determines a torque request based on the user input from the user input module 104. For example, the torque request module 204 may store one or more mappings of accelerator pedal position to desired torque and determine the torque request based on a selected one of the mappings. The torque request module 204 may select one of the mappings based on the engine speed and/or vehicle speed. The torque request module 204 outputs the torque request.

The throttle control module 206 controls the throttle valve 112 by instructing the throttle actuator module 116 to achieve a desired throttle area. The fuel control module 208 controls the fuel injector 125 by instructing the fuel actuator module 124 to achieve a desired pulse width. The spark control module 210 controls the spark plug 128 by instructing the spark actuator module 126 to achieve desired spark timing.

The throttle control module 206 and the spark control module 210 may adjust the desired throttle area and the desired spark timing, respectively, based on the torque request. The throttle control module 206 may increase or decrease the desired throttle area when the torque request increases or decreases, respectively. The spark control module 210 may advance or retard the spark timing when the torque request increases or decreases, respectively.

The fuel control module 208 may adjust the desired pulse width to achieve a desired air/fuel ratio such as a stoichiometric air/fuel ratio. For example, the fuel control module 208 may adjust the desired pulse width to minimize a difference between an actual air/fuel ratio and the desired air/fuel ratio. Controlling the air/fuel ratio in this way may be referred to as closed-loop control of the air/fuel ratio.

The example implementation of the ECM 114 shown in FIG. 2 further includes an air flow rate module 212, an air mass module 214, a desired fuel mass module 216, a fuel correction factor module 218, a fault command module 220, and a fault detection module 222. The air flow rate module 212 determines a mass flow rate of air entering each cylinder of the engine 102. During steady-state conditions, the air flow rate module 212 may divide the mass flow rate of intake air from the MAF sensor 186 by the number of cylinders in the engine 102 to obtain the mass flow rate of air entering each cylinder. The air flow rate module 212 may determine that the engine 102 is operating in steady-state conditions when the manifold pressure from the MAP sensor 184 is less than a predetermined pressure.

During transient conditions, the air flow rate module 212 may determine the mass flow rate of air entering each cylinder based on the manifold pressure from the MAP sensor 184, the intake air temperature from the IAT sensor 192, and the engine speed. The air flow rate module 212 may determine the mass flow rate of air entering each cylinder based on these parameters using an equation and/or a lookup table. The air flow rate module 212 may determine that the engine 102 is operating in transient conditions when the manifold pressure from the MAP sensor 184 is greater than or equal to the predetermined pressure. The air flow rate module 212 outputs the mass flow rate of air entering each cylinder.

The air mass module 214 determines a mass of air drawn into each cylinder of the engine 102 based on the mass flow rate of air entering each cylinder and a corresponding period. For example, the air mass module 214 may integrate the mass flow rate of air entering a cylinder by a period corresponding to an intake stroke of the cylinder to obtain the mass of air drawn into the cylinder during the intake stroke. The air mass module 214 outputs the mass of air drawn into each cylinder.

The desired fuel mass module 216 determines a desired mass of fuel to deliver to each cylinder of the engine 102 based on the mass of air drawn into a cylinder and the desired air/fuel ratio. Some of the mass of fuel delivered to a cylinder may not be combusted, but instead may wet a wall of the cylinder. The desired fuel mass module 216 may determine this wall-wetting fuel mass based on engine operating conditions and increase the desired fuel mass by the wall-wetting fuel mass. The desired fuel mass module 216 outputs the desired fuel mass for each cylinder of the engine 102.

The fuel correction factor module 218 determines a fuel correction factor based on the upstream oxygen level from the UO2 sensor 194 and/or the downstream oxygen level from the DO2 sensor 196. For example, the fuel correction factor module 218 may determine an actual air/fuel ratio associated with each cylinder of the engine 102 based on the upstream oxygen level and/or the downstream oxygen level. The fuel correction factor module 218 may then determine the fuel correction factor for a cylinder based on a difference between the desired air/fuel ratio and the actual air/fuel ratio associated with the cylinder. For example, the fuel correction factor module 218 may increase the fuel correction factor as this difference increases and vice versa. The fuel correction factor module 218 outputs the fuel correction factor for each cylinder of the engine 102.

The fuel control module 208 determines the desired pulse width for each cylinder of the engine 102 based on the desired fuel mass and the fuel correction factor for the cylinder. The fuel correction factor may be a multiplier, in which case the fuel control module 208 may determine the desired pulse width based on a product of the desired fuel mass and the fuel correction factor. Alternatively, the fuel correction factor may be a mass, in which case the fuel control module 208 may determine the desired pulse width based on a sum of the desired fuel mass and the fuel correction factor.

The fault detection module 220 may detect various faults in the engine system 100 based on signals received by the ECM 114 and activate the service indicator 198 when a fault is detected. The fault detection module 220 may detect misfire in a cylinder of the engine 102 based on changes in the engine speed or engine torque associated with the cylinder. For example, the fault detection module 220 may detect misfire in a cylinder based on engine deceleration and jerk associated with the cylinder. The fault detection module 220 may detect misfire when the engine deceleration and jerk are less than predetermined values. In another example, the fault detection module 220 may detect misfire in a cylinder when a decrease in engine torque associated with the cylinder is less than a predetermined value.

The fault detection module 220 determines the engine deceleration and jerk by differentiating the engine speed with respect to time. Thus, the engine deceleration and jerk are derivatives of the engine speed with respect to time. The fault detection module 220 may select the predetermined values based on the engine speed and engine load. In addition, the fault detection module 220 may compare the engine deceleration and jerk to multiple sets of predetermined values to detect different types of misfire.

The fault detection module 220 may also detect a fuel system fault when the fuel correction factor is outside of a first predetermined range. For example, the fault detection module 220 may detect a lean air/fuel ratio fault when the fuel correction factor is greater than or equal to a first predetermined value (e.g., 25% or 1.25). Conversely, the fault detection module 220 may detect a rich air/fuel ratio fault when the fuel correction factor is less than or equal to a second predetermined value (e.g., −25% or 0.75). The predetermined range may be between, but not inclusive of, the first and second predetermined values.

The fault command module 222 selectively generates a command to induce a fuel system fault based on the user input from the user input module 104. For example, the fault command module 222 may generate the command to induce a fuel system fault when a user provides an instruction to the ECM 114 using a touchscreen or handheld tool that interfaces with the ECM 114. The fault command module 222 sends the command to induce a fuel system fault to the fuel control module 208.

The fuel control module 208 adjusts the fuel correction factor to a target value in response to the command to induce a fuel system fault. The target value may be a predetermined value that is outside of the predetermined range. In various implementations, the user input may indicate whether a lean or rich air/fuel ratio fault is desired, and the command to induce a fuel system fault may indicate the same. In this case, the fuel control module 208 may select the target value from multiple predetermined values based on whether a lean or rich air/fuel ratio fault is desired. For example, the fuel control module 208 may set the target value equal to the first predetermined value (e.g., 25% or 1.25) when the user selects a lean air/fuel ratio fault. Conversely, the fuel control module 208 may set the target value equal to the second predetermined value (e.g., −25% or 0.75) when the user selects a rich air/fuel ratio fault.

The fuel control module 208 may adjust the fuel correction factor to the target value at a predetermined rate when the command to induce a fuel system fault is initially generated (e.g., during the first iteration of adjusting the fuel correction factor). The fuel control module 208 may then decrease the rate at which the fuel correction factor is adjusted based on a change in engine speed and/or an unadjusted value of the fuel correction factor. In other words, the fuel control module 208 may select a rate that is less than the predetermined rate based on the change in engine speed and/or the unadjusted value of the fuel correction factor, and then adjust the fuel correction factor based on the selected rate. The unadjusted value of the fuel correction factor is the value of the fuel correction factor before the fuel correction factor is adjusted by the fuel control module 208 (e.g., the value of the fuel correction factor that is output by the fuel correction factor module 218).

In one example, the fuel control module 208 may adjust the fuel correction factor at a rate that is less than the predetermined rate when the unadjusted value of the fuel correction factor is outside of a second predetermined range. The second predetermined range may be smaller than the first predetermined range. The fuel control module 208 may decrease the rate at which the fuel correction factor is adjusted by an amount that is directly proportional to the amount by which the unadjusted value of the fuel correction factor is outside of the second predetermined range.

In another example, the fuel control module 208 may adjust the fuel correction factor at a rate that is less than the predetermined rate when a derivative of the engine speed with respect to time is less than a predetermined value. As discussed above, the fault detection module 220 may detect misfire when a derivative of the engine speed, such as engine deceleration and/or engine jerk, is less than the predetermined value. Thus, the fuel control module 208 may inhibit misfire by decreasing the rate at which the fuel correction factor for a cylinder is adjusted when a derivative of the engine speed associated with that cylinder is less than the predetermined value.

In various implementations, the fuel control module 208 may decrease the rate at which the fuel correction factor for a cylinder is adjusted when misfire in the cylinder is detected. The fuel control module 208 may decrease the rate at which the fuel correction factor is adjusted by an amount that is directly proportional to the number of misfire detections. Additionally or alternatively, the fuel control module 208 may decrease the rate at which the fuel correction factor is adjusted by an amount that is directly proportional to a number of times that a derivative of the engine speed is less than the predetermined value.

Figure 3:
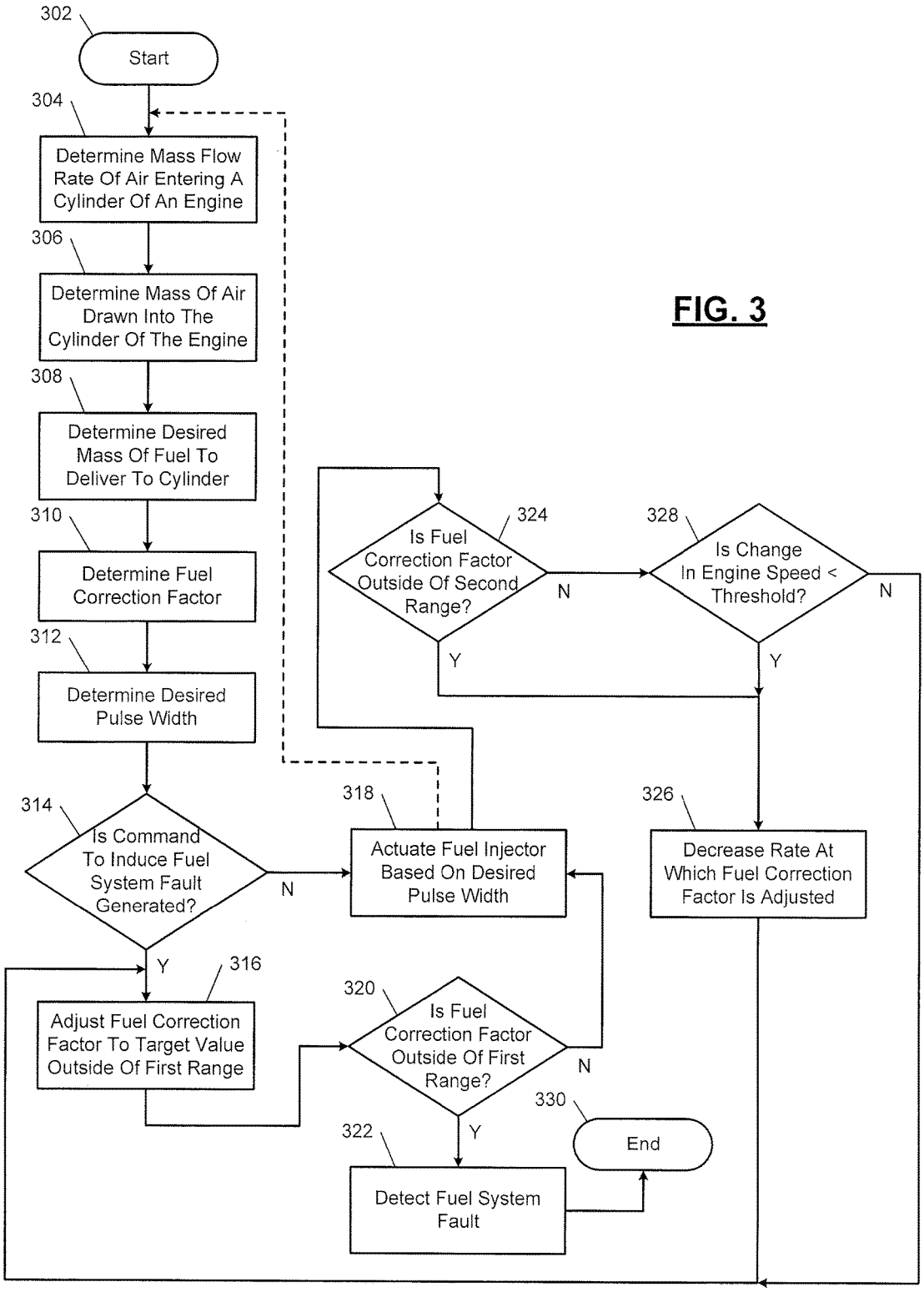
FIG. 3 is a flowchart illustrating an example control method according to the principles of the present disclosure.

Referring now to FIG. 3, a method for inducing a fuel system fault begins at 302. The method of FIG. 3 is described in the context of the modules included in the example implementation of the ECM 114 shown in FIG. 2. However, the particular modules that perform the steps of the method of FIG. 3 may be different than the modules mentioned below and/or the method of FIG. 3 may be implemented apart from the modules of FIG. 3.

At 304, the air flow rate module 212 determines the mass flow rate of air entering a cylinder of the engine 102. As noted above, air flow rate module 212 may determine the mass flow rate of air entering a cylinder based on different parameters depending on whether the engine 102 is operating in steady-state or transient conditions. At 306, the air mass module 214 determines the mass of air drawn into the cylinder based on the mass flow rate of air entering the cylinder and a corresponding period.

At 308, the desired fuel mass module 216 determines the desired mass of fuel to deliver to the cylinder based on the mass of air drawn into the cylinder and the desired air/fuel ratio. At 310, the fuel correction factor module 308 determines a fuel correction factor for the cylinder based on the upstream oxygen level and/or the downstream oxygen level. At 312, the fuel control module 208 determines a desired pulse width based on the desired fuel mass and the fuel correction factor.

At 314, the fuel control module 208 determines whether a command to induce a fuel system fault is generated. As noted above, the fault command module 222 may generate a command to induce a fuel system fault based on a user input. If a command to induce a fuel system fault is generated, the method continues at 316. Otherwise, the method continues at 318.

At 316, the fuel control module 208 adjusts the fuel correction factor to a target value that is outside of the first predetermined range. As noted above, fuel control module 208 adjusts the fuel correction factor to the target value at a predetermine rate when the command to induce the fuel system fault is initially generated. For example, the fuel control module 208 may increase or decrease the fuel correction factor by a predetermined amount each time that 316 is executed, and 316 may be executed at a frequency that is based on a predetermined loop rate (e.g., 20 milliseconds). Thus, the predetermined rate may be equal to the predetermined amount divided by the predetermined loop rate. The predetermined amount may be less than the target value.

At 320, the fault detection module 220 determines whether the fuel correction factor is outside of the first predetermined range. If the fuel correction factor is outside of the first predetermined range, the method continues at 322. Otherwise, the method continues at 318. At 322, the fault detection module 220 detects a fuel system fault.

At 318, the fuel control module 208 actuates the fuel injector 125 based on the desired pulse width. Then, if a command to induce a fuel system fault is generated, the method may continue at 324. Otherwise, the method may continue at 304.

At 324, the fuel control module 208 determines whether the fuel correction factor is outside of the second predetermined range. If the fuel correction factor is outside of the second predetermined range, the method continues at 326. Otherwise, the method continues at 328.

At 328, the fuel control module 208 determines whether a change in the engine speed associated with the cylinder is less than a threshold. For example, the fuel control module 208 may determine whether a derivative of the engine speed with respect to time is less than a predetermined value, as discussed above. Additionally or alternatively, the fuel control module 208 may determine whether misfire in the cylinder is detected. If the change in the engine speed is less than the threshold (or if misfire is detected), the method continues at 326. Otherwise, the method continues at 316.

At 326, the fuel control module 208 decreases a rate at which the fuel correction factor is adjusted based on a change in engine speed and/or an unadjusted value of the fuel correction factor. For example, the fuel control module 208 may select a rate that is less than the predetermined rate based on the change in engine speed and/or the unadjusted value of the fuel correction factor. The method may then continue at 316 and adjust the fuel correction factor at the selected rate. The method may continue to adjust the fuel correction factor until the fault detection module 220 determines that the fuel correction factor is outside of the first predetermined rate at 320 and detects a fuel system fault at 322. The method may then end at 330.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A system comprising:

a fault command module that selectively generates a command to induce a fuel system fault based on a user input;

a fuel control module that:

automatically adjusts a fuel correction factor to a target value outside of a first predetermined range in response to the command to induce a fuel system fault; and actuates a fuel injector associated with a cylinder of an engine based on the fuel correction factor; and a fault detection module that detects a fuel system fault when the fuel correction factor is outside of the first predetermined range.

2. The system of claim 1 wherein the fuel control module selectively adjusts the fuel correction factor to the target value at a predetermined rate when the command to induce a fuel system fault is generated.

3. The system of claim 2 wherein the fuel control module selectively adjusts the fuel correction factor at a rate that is different than the predetermined rate based on at least one of a change in engine speed and an unadjusted value of the fuel correction factor.

4. The system of claim 3 wherein the fuel control module adjusts the fuel correction factor at a rate that is less than the predetermined rate when the unadjusted value of the fuel correction factor is outside of a second predetermined range.

5. The system of claim 3 wherein the fuel control module adjusts the fuel correction factor at a rate that is less than the predetermined rate when a derivative of the engine speed with respect to time is less than a predetermined value.

6. The system of claim 3 further comprising a fuel correction factor module that determines the unadjusted value of the fuel correction factor based on an input from an oxygen sensor disposed in an exhaust system of the engine.

7. The system of claim 1 wherein the fuel control module:

determines a desired pulse width based on the fuel correction factor and a desired mass of fuel to deliver to the cylinder; and actuates the fuel injector based on the desired pulse width.

8. The system of claim 7 further comprising a desired fuel mass module that determines the desired fuel mass based on a desired air/fuel ratio and a mass of air drawn into the cylinder.

9. The system of claim 8 further comprising an air mass module that determines the mass of air drawn into the cylinder based on a mass flow rate of air entering the cylinder and a corresponding period.

10. The system of claim 9 further comprising an air flow rate module that determines the mass flow rate of air entering the cylinder based on at least one of (i) a mass flow rate of air entering an intake manifold of the engine and (ii) a pressure within the intake manifold, a temperature of air entering the intake manifold, and engine speed.

11. A method comprising:

selectively generates a command to induce a fuel system fault based on a user input;

automatically adjusting a fuel correction factor to a target value outside of a first predetermined range in response to the command to induce a fuel system fault;

actuating a fuel injector associated with a cylinder of an engine based on the fuel correction factor; and detecting a fuel system fault when the fuel correction factor is outside of the first predetermined range.

12. The method of claim 11 further comprising selectively adjusting the fuel correction factor to the target value at a predetermined rate when the command to induce a fuel system fault is generated.

13. The method of claim 12 further comprising selectively adjusting the fuel correction factor at a rate that is different than the predetermined rate based on at least one of a change in engine speed and an unadjusted value of the fuel correction factor.

14. The method of claim 13 further comprising adjusting the fuel correction factor at a rate that is less than the predetermined rate when the unadjusted value of the fuel correction factor is outside of a second predetermined range.

15. The method of claim 13 further comprising adjusting the fuel correction factor at a rate that is less than the predetermined rate when a derivative of the engine speed with respect to time is less than a predetermined value.

16. The method of claim 13 further comprising determining the unadjusted value of the fuel correction factor based on an input from an oxygen sensor disposed in an exhaust system of the engine.

17. The method of claim 11 further comprising:

determining a desired pulse width based on the fuel correction factor and a desired mass of fuel to deliver to the cylinder; and actuating the fuel injector based on the desired pulse width.

18. The method of claim 17 further comprising determining the desired fuel mass based on a desired air/fuel ratio and a mass of air drawn into the cylinder.

19. The method of claim 18 further comprising determining the mass of air drawn into the cylinder based on a mass flow rate of air entering the cylinder and a corresponding period.

20. The method of claim 19 further comprising determining the mass flow rate of air entering the cylinder based on at least one of (i) a mass flow rate of air entering an intake manifold of the engine and (ii) a pressure within the intake manifold, a temperature of air entering the intake manifold, and engine speed.

* * * * *